US006116846A

United States Patent [19]

Bulkley

[11] Patent Number: 6,116,846

[45] Date of Patent: Sep. 12, 2000

[54] FRONT END LOADER ASSEMBLY FOR A VEHICLE

[76] Inventor: Neil Bulkley, P.O. Box 185, Morton, Pa. 19070

[21] Appl. No.: 09/062,693

[22] Filed: Apr. 20, 1998

[51] Int. Cl.[7] ..... E02F 3/00

[52] U.S. Cl. ..... 414/700; 414/686

[58] Field of Search ..... 414/680, 685, 414/686, 912, 700, 706, 708

[56] References Cited

U.S. PATENT DOCUMENTS

| | | | |
|---|---|---|---|
| 2,489,629 | 11/1949 | Ford | 414/685 X |
| 2,822,941 | 2/1958 | Harter | 414/685 |
| 3,876,092 | 4/1975 | MacDonald . | |
| 4,923,362 | 5/1990 | Fryk | 414/708 X |
| 5,184,932 | 2/1993 | Misuda | 414/685 |
| 5,535,533 | 7/1996 | Romanchok | 37/403 |
| 5,582,502 | 12/1996 | Herin | 414/685 |
| 5,595,471 | 1/1997 | Ajilore | 414/685 |
| 5,674,046 | 10/1997 | Meyer | 414/686 |
| 5,695,310 | 12/1997 | Foster et al. | 414/722 X |

*Primary Examiner*—Donald W. Underwood
*Attorney, Agent, or Firm*—LaMorte & Associates

[57] ABSTRACT

A front end loader assembly that is attachable to a truck not otherwise intended to use a front end loader. The front end loader assembly includes a stationary mount that attaches to the chassis of the vehicle. A frame structure is provided having a pair of generally vertical frame elements and at least one generally horizontal frame element. The frame structure is pivotably coupled to the stationary mount at a first point of attachment. A single first hydraulic cylinder extending between the stationary mount and the frame structure, wherein the first hydraulic cylinder is capable of moving the frame structure relative the stationary mount about the first point of attachment. An arm structure is coupled to the frame structure by a hinged connection. A single second hydraulic cylinder extends between the frame structure and the arm structure, wherein the second hydraulic cylinder is capable of moving the arm structure relative the frame assembly. A bucket is coupled to the arm structure. A third cylinder is coupled between the bucket and the arm structure for selectively moving the bucket relative to the arm structure.

9 Claims, 6 Drawing Sheets

FRONT END LOADER ASSEMBLY FOR A VEHICLE

BACKGROUND OF THE INVENTION

1. Field of the Invention

The present invention relates to front end loader assemblies that are commonly used to lift and move loose material such as dirt, gravel, snow and the like. More specifically, the present invention relates to front end loader assemblies that are selectively attachable to vehicles.

2. Description of the Prior Art

The prior art record is replete with many different types of front end loader assemblies. Front end loader assemblies typically include a lift bucket. The lift bucket is attached to a linkage arrangement that supports the lift bucket at various positions and orientations. Hydraulic cylinders engage the lift bucket and support linkages at various points. By selectively controlling the various hydraulic cylinders, the bucket can be moved throughout a large range of motions.

Front end loader assemblies are commonly used on construction equipment such a bulldozers and back hoes. On such vehicles, the front end loaders are used to move earth, gravel, stones and other loose or heavy materials. Since the front end loaders are used to move heavy materials, such front end loaders are typically constructed from large and heavy metal components that are capable of bearing the large stresses incurred. Heavily constructed front end loader assemblies present no problem to construction vehicles such as bulldozers and back hoes, because such vehicles have large engines, heavy frames and they are designed to hold the weight of a large heavy front end loader assembly. However, these same front end loader assemblies cannot be used on common road vehicles because they are too heavy and would damage most any truck or other road vehicle to which they were attached.

Construction vehicles such as bulldozers and back hoes are expensive and are not practical for an average person to own. However, many people have the occasional need to use a front end loader to move snow, spread mulch, move dirt, or the like. Traditional front end loader assemblies cannot be attached to passenger vehicle because traditional front end loaders are too heavy for the frames of the vehicle and require anchoring points not available on trucks and passenger vehicles. As a result, people must rent a construction vehicle with a front end loader or do without.

Municipalities, and other local authorities also commonly need front end loaders to remove snow and other debris from streets. Municipalities have many different types of vehicles at their disposal. However, most municipalities only have only one or just a few construction vehicles with front end loaders. These few vehicles are insufficient to clear snow from the numerous streets in a municipality after a major snow storm. It may therefore take a municipality several days to clear snow away from vital facilities after a significant snow fall.

A need therefore exists in the art for a light front end loader assembly that can be attached to large road vehicle such as a full sized pick-up truck, dump truck, garbage truck or the like. Such a front end loader assembly would enable individuals and municipalities to add front end loaders to vehicles they already own. Consequently, a vehicle with a front end loader can be readily produced at the fraction of the price of purchasing a construction vehicle with a typical prior art front end loader.

SUMMARY OF THE INVENTION

The present invention is a front end loader assembly that is attachable to a truck or other common road vehicle that is not designed to use a front end loader. The front end loader assembly includes a stationary mount with a base that attaches to the chassis of the vehicle. The stationary mount also includes a support frame that extends upwardly in front of the vehicle's bumper. A frame structure is provided having a pair of generally vertical frame elements and at least one generally horizontal frame elements. The frame structure is pivotably coupled to the stationary mount at a first point of attachment. A single first hydraulic cylinder extending between the stationary mount and the frame structure, wherein the first hydraulic cylinder is capable of moving the frame structure relative the stationary mount about the first point of attachment. An arm structure is coupled to the frame structure by a hinged connection, wherein the hinged connection exists between the vertical frame elements of the frame structure. A single second hydraulic cylinder extends between the frame structure and the arm structure, wherein the second hydraulic cylinder is capable of moving the arm structure relative the frame assembly. A bucket is coupled to the arm structure. A third cylinder is coupled between the bucket and the arm structure for selectively moving the bucket relative to the arm structure.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE INVENTION

Figure 1:
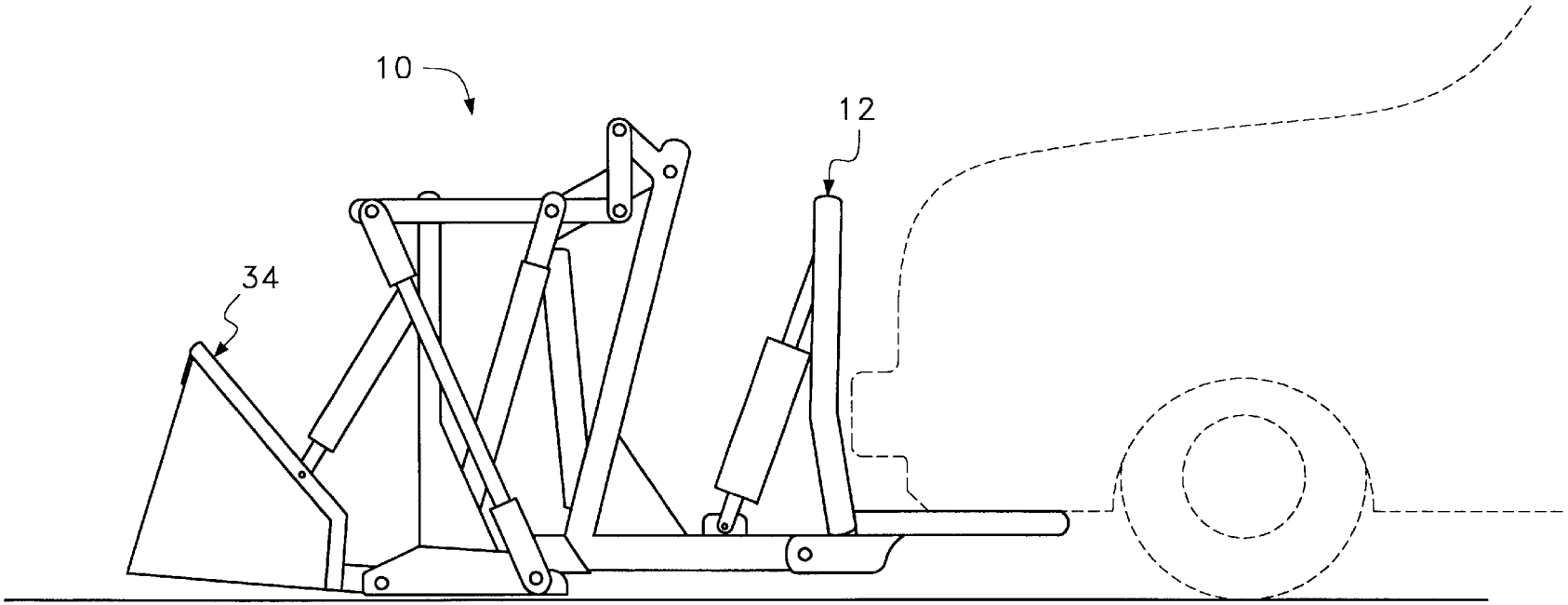
FIG. 1 is a side view of a first preferred embodiment of the present invention front end loader assembly, shown in conjunction with a vehicle.

Referring to FIG. 1, a first preferred embodiment of the present invention front end loader assembly 10 is shown. The front end loader assembly 10 is a light weight assembly that is specifically designed for use on common road vehicles, such as pick-up trucks and dump trucks, that are not designed to use front end loaders. As will be later explained, the front end loader assembly 10 does not require that the vehicle have any specialized mounts. Rather, the front end loader assembly 10 is capable of being mounted to most any truck or other large vehicle as that vehicle manufactured by the factory.

The purpose of the front end loader assembly 10 is to provide to individuals and municipalities, the ability to convert and existing vehicle, such as a pick-up truck, a dump truck, a garbage truck or other vehicle into a front end loader. The front end loader assembly 10 is light weight, yet has the power to lift loose material such as snow, sand, gravel, mulch, soil and the like. Consequently, individuals can own their own front end loader for a reasonable price and municipalities can convert existing vehicle into snow removal equipment.

Figure 2:
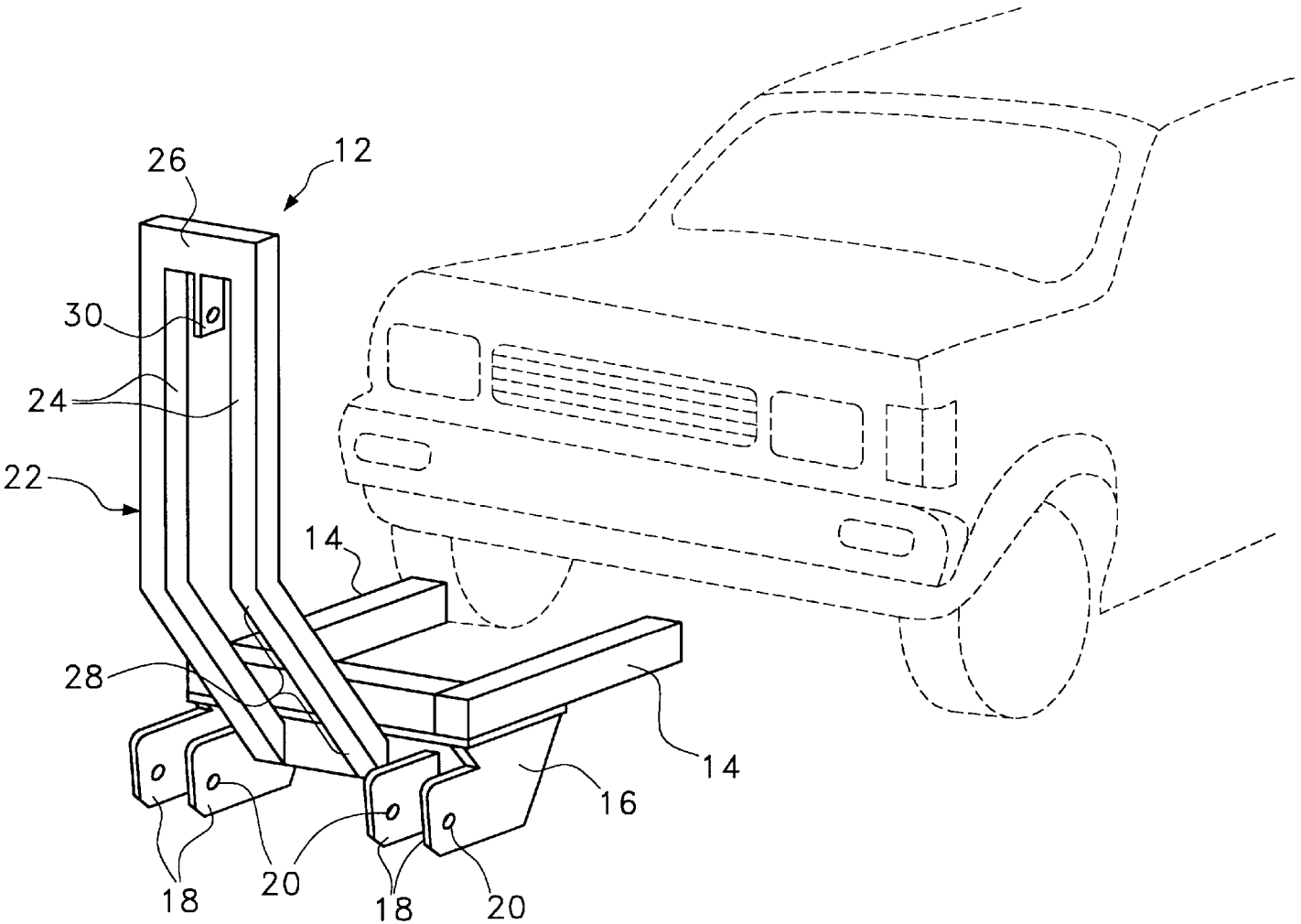
FIG. 2 is a perspective view of the stationary mount portion of the present invention front end loader assembly, shown in conjunction with a vehicle.

Referring to FIG. 2, it can be seen that the first section of the present invention front end loader assembly that attaches to a vehicle is a stationary mount 12. The stationary mount 12 contains at least two frame elements 14 that bolt to the chassis frame of a vehicle under the front end of the vehicle. The length shape and distance between the frame elements 14 will vary from one vehicle model to another. Accordingly, the stationary mount 12 is ordered by a purchaser to match the type of vehicle onto which the front end loader assembly 10 (FIG. 1) is being attached. Different vehicles have different chassis frames and various under chassis elements. By custom ordering a stationary mount 12 for a particular type of vehicle, it can be ensured that the stationary mount 12 will fit properly and will not interfere with other under chassis elements of the vehicle.

A mounting bracket 16 is supported under the framing elements 14. The mounting bracket 16 contains two sets of flanges 18. Concentric apertures 20 are disposed between the flanges 18 in each pair.

A support frame 22 extends upwardly from the mounting bracket 16. The support frame 22 contains two vertical elements 24 and a horizontal cross element 26 that joins the tops of the vertical elements 24 together. The lower 28 portion of the vertical elements 24 may be angled away from the vertical. This allows the stationary mount 12 to attach to a vehicle without the vertical elements 24 touching the front bumper of the vehicle. In many vehicles with air bags, the trigger for the air bag is contained within the front bumper of that vehicle. By keeping the stationary mount 12 away from the front bumper, it is less likely that the front end loader assembly 10 (FIG. 1) will accidently trigger the vehicle's air bag during the use of the front end loader assembly.

A cylinder mounting plate 30 extends downwardly from the horizontal cross element 26 that joins the two vertical elements 24 together. The cylinder mounting plate 30 is adapted to receive the primary lift cylinder (not shown) as will later be explained.

Figure 3:
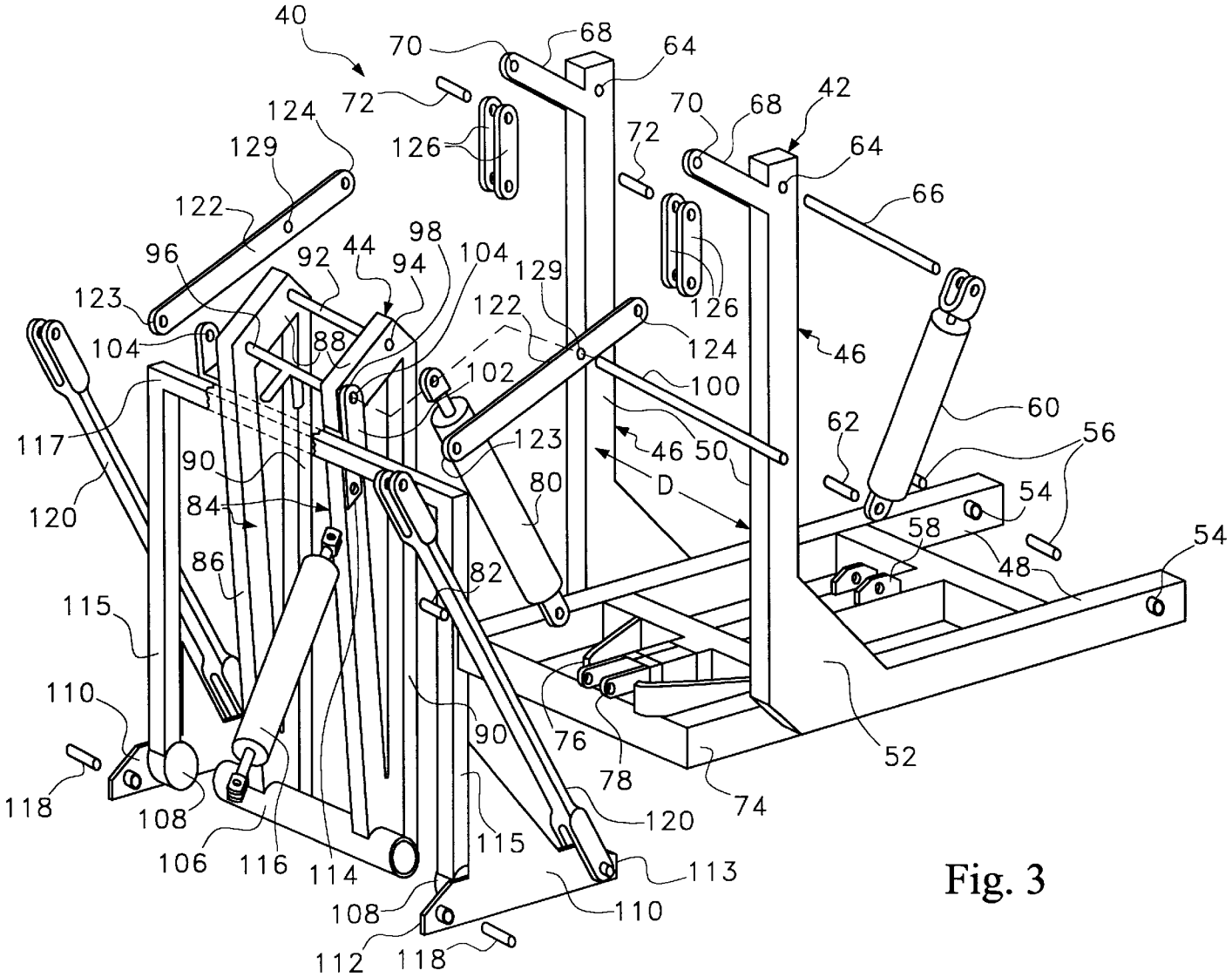
FIG. 3 is an explode perspective view of the linking assembly portion of the present invention front end loader assembly.

Referring to FIG. 3, an exemplary embodiment of a linkage assembly 40 is shown. The linkage assembly 40 is the section of the front end loader assembly 10 (FIG. 1) that is articulated and attaches a bucket 34 (FIG. 1) to the stationary mount 12 (FIG. 1) that is attached to a vehicle. The linkage assembly 40 contains two main frame elements. These frame elements include an L-shaped frame assembly 42 and an lift arm frame assembly 44.

The L-shaped frame assembly 42 is comprised of two L-shaped frame elements 46 that are spaced a predetermined distance D apart by a series of cross elements. Each of the L-shaped frame elements 46 has a horizontal segment 48 and a vertical segment 50. The vertical segment 50 joins to the horizontal segment 48 at an angle of between 75 degrees and 90 degrees. An optional angle bracket 52 can be placed between the horizontal segment 48 and the vertical segment 50 to reinforce the point of junction. The free end of each of the horizontal segments 48 contains a pin aperture 54. The width and spacing of the horizontal segments 48 are designed so that the free ends of the horizontal segments 48 can fit between each pair of mounting flanges 18 (FIG. 2) on the stationary mount 12 (FIG. 2). A pivot pin 56 passes through the apertures 20 (FIG. 2) in the mounting bracket 18 (FIG. 2) and the pin apertures 54 in the horizontal segments 48, thereby joining the L-shaped frame elements 46 to the stationary mount 12 (FIG. 2) with a hinged connection.

A cylinder mount 58 is disposed at a point between the L-shaped frame elements 46 at a point proximate the mid-length of each horizontal segment 48. The cylinder mount 58 attaches to one end of the primary lift cylinder 60 with a pivot pin 62. The opposite end of the primary lift cylinder 60 attaches to the cylinder mount 30 (FIG. 2) that extends from the top of the stationary mount 12 (FIG. 2). As a result, as the primary lift cylinder 60 expands and contracts, the entire L-shaped frame assembly 40 is rotated about pivot pins 56 at the free end of the horizontal segments 48 and the entire L-shaped frame assembly 40 moves relative the stationary mount 12 (FIG.2).

Pivot rod apertures 64 are formed through the free end of the vertical segments 50 of the L-shaped frame elements 46. The pivot rod apertures 64 are concentrically aligned and sized to receive a pivot rod 66. Short arms 68 extend from the vertical segments 50 of the L-shaped frame elements 46 at points near their free ends. The short arms 68 slope upwardly at an acute angle with respect to the horizontal. Pivot pin apertures 70 are disposed in the short arms 68 proximate their free ends. The apertures 70 are sized to receive pivot pins 72, the purpose of which will be later explained.

A base frame structure 74 extends forward of the L-shaped frame elements 46 from the point where the vertical segment 50 of the L-shaped frame elements 46 meets the horizontal segments 48. The base frame structure 74 is rigidly affixed to the L-shaped frame elements 46 and lays in the same general plane as does the horizontal segments 48 of the L-shaped frame elements 46. Guide arms 76 extend forward of the base frame structure 74. The guide arms 76 are slightly tapered so that the front ends of the guide arms 76 are closer together than is the base of the guide arms 76. The purpose of the guide arms 76 will later be explained.

A cylinder mount 78 is affixed to the base frame structure 74 at a point between the guide arms 76. The cylinder mount 78 attaches to one end of an arm lift cylinder 80 with a pivot pin 82. The arm lift cylinder 80 lifts the lift arm frame assembly 44 in a manner which will later become apparent.

The lift arm frame assembly 44 is comprised of two maim frame elements 84. Each of the main frame elements 84 is generally J-shaped, having a straight vertical element 86 and a foot segment 88 that extends away from the vertical element 86 at an obtuse angle. The free end of the foot segment 88 and the free end of the vertical element 86 are joined together by an optional reinforcement element 90, thereby forming a triangular truss. The two main frame elements 84 are joined together by three hollow tubes. The first hollow tube 92 is positioned between the ends of the foot segment 88 of the main frame elements 84. Apertures 94 are formed at this position in the foot segment 88 that communicate with the interior of the hollow tube 92. As a result, a continuous conduit is formed through the arm frame assembly 44 that is sized to accept the first pivot rod 66 therein.

The second hollow tube 96 is positioned between the main frame elements 84 where the foot segment 88 of each main frame element 84 meets the straight vertical element 86. Apertures 98 are formed at this position that communicate with the interior of the second hollow tube 96. As a result, a continuous conduit is formed through the arm frame assembly 14 that is sized to accept a second pivot rod 100. Hinge brackets 102 are disposed on the exterior of both main frame elements 84. The hinge brackets 102 contain apertures 104 that align with the interior of the second hollow tube 96. The function of the hinge elements 102 is later explained.

The third hollow tube 106 is positioned at the base of the vertical element 86 of each main frame element 84. The third hollow tube 106 has two open ends, wherein the third hollow tube 106 is sized to receive a bucket axle 108 therein. The bucket axle 108 terminates at both ends with a pivot arm plate 110. As a result, the pivot arm plates 110 are free to rotate with the bucket axle 108 as the bucket axle turns within the third hollow tube 106. Each of the pivot arm plates 110 has a front end 112 and a back end 113. The bucket axle 108 is joined to the pivot arm plates 110 at a point between the midpoint and the front end 112 of the pivot arm plates 110.

A bucket support frame 115 extends upwardly from the pivot arm plates 110. The bucket support frame 115 has a generally inverted U-shape, wherein two vertical elements support a horizontal cross element 117. A cylinder mount 114 extends downwardly from the middle of the horizontal cross element 117. The cylinder mount 114 joins to a bucket cylinders 116 that is used to turn the bucket assembly 34 (shown in FIG. 4).

Apertures 116 are also formed in the pivot arm plates 110 at a point proximate the front end 112 of the pivot arm plates 110. The apertures 116 are sized to receive pivot pins 118 that join the front end 112 of the pivot arm plates 110 to the bucket 34 (FIG.4), as will later be explained.

A first linkage arm 120 is attached to the back end 113 of each pivot arm plate 110 with a hinged connection. The first linkage arm 120 extends upward and engages the front end 123 of a second linkage arm 122 with yet another hinged connection. The back end 124 of the second linkage arm 122 connects to suspension linkages 126 that support the back end 124 of the second arm linkage 122 from the short arms 68 that extend from the L-shaped frame elements 46. The interconnections between the support linkages 126 and the second arm linkage 122 are all achieved with pivot pins (not shown) that allow independent movement of each element.

The second linkage arm 122 contains three apertures. One aperture exists at each end of the second linkage arm 122 and one aperture 129 exists at a point between the middle of the second linkage arm 122 and its back end 124. As has previously been explained, the back end 124 of the second linkage arm 122 is attached to support linkages 126 and the front end 123 of the second linkage arm 122 is attached to the first linkage arm. The second linkage arm 122 rests in the hinge bracket 102 that extends from the main frame element 84 of the lift arm frame assembly 44. The second pivot rod 100 extends through the hinge bracket 102, the middle aperture 129 in the second linkage arm 122 and the second hollow tube 96 in the lift arm frame assembly 44. The second pivot rod 100 therefore becomes the fulcrum point around which the second linkage arm 122 pivots.

When assembled, the foot segment 88 of the main frame elements 84 on the lift arm frame assembly 44 pass between the free ends of the vertical segments 50 of the L-shaped frame elements 46. The interior of the first hollow tube 92 on the lift arm frame assembly 44 aligns with the apertures 64 at the free end of the vertical segments 50 of the L-shaped frame elements 46. The first pivot rod 66 passes through the apertures 64 in the vertical segments 50 of the L-shaped frame elements 46 and the first hollow tube 92. This creates a hinged connection between the L-shaped frame assembly 42 and the lift arm frame assembly 44.

The arm lifting cylinder 80 engages the exterior of the second hollow tube 96 of the lift arm frame assembly 44 at a point around the midpoint of the second hollow tube 96. As the lift cylinder 80 expands and contracts, the lift arm frame assembly 44 rotates about the first pivot rod 66 and moves with respect to the L-shaped frame assembly 42.

When the arm lift cylinder 80 is fully contracted, the bottom of the lift arm frame assembly 44 abuts against the base frame structure 74 of the L-shaped frame assembly 42. The guide arms 76 extending from the base frame structure 74 help guide the lift arm frame assembly 42 into position so that the majority of the lift arm frame assembly 44 is positioned between the L-shaped frame elements 46 of the L-shaped frame assembly 42.

Figure 4:
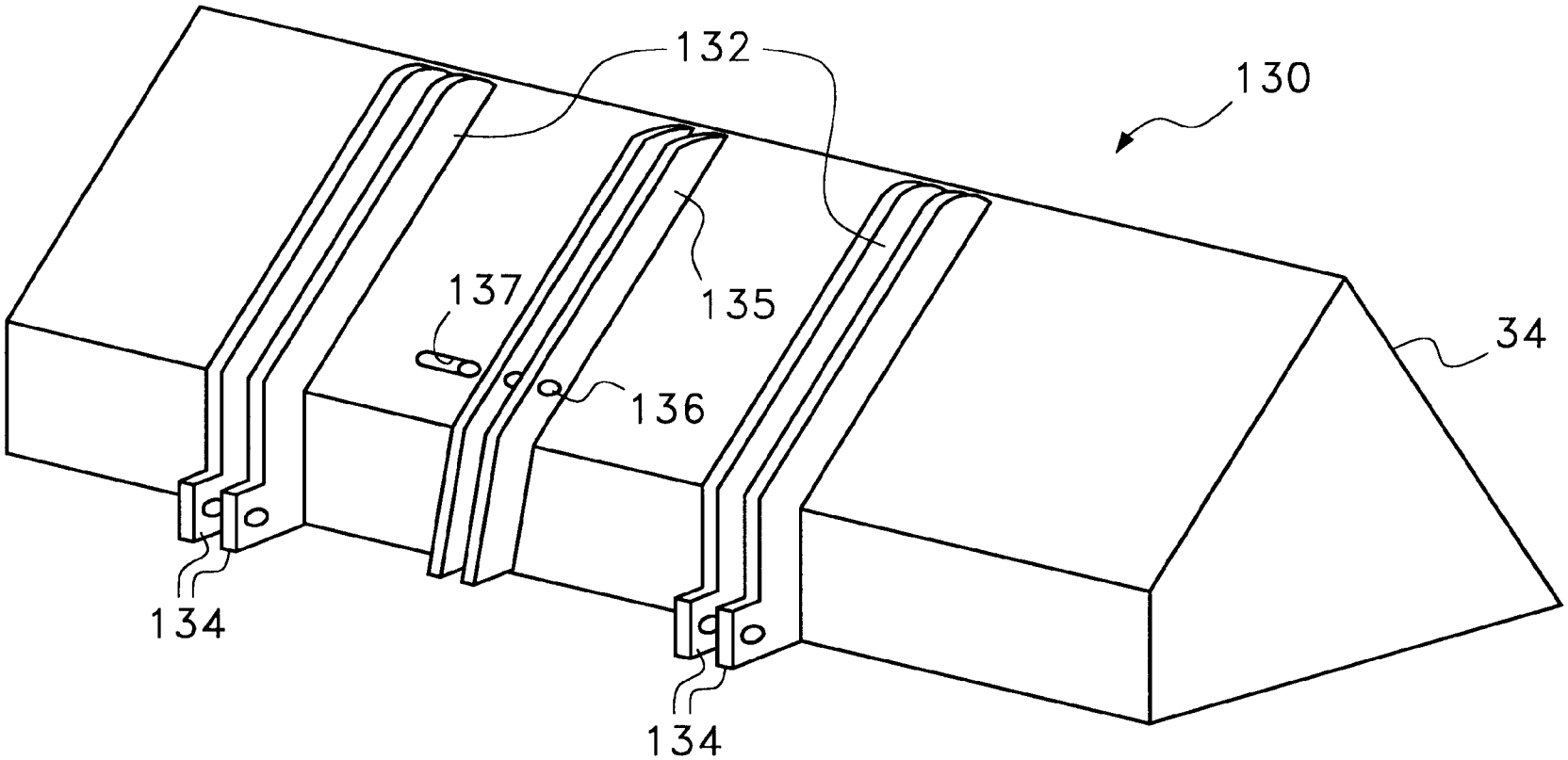
FIG. 4 is a perspective view of the bucket portion of the present invention front end loader assembly.

Referring to FIG. 4, an exemplary embodiment of a bucket assembly 130 is shown. The bucket assembly 130 includes a light weight bucket 34 formed in the shape of traditional front end loader buckets. On the rear surfaces of the bucket 34 are formed two mounting brackets 132 and a cylinder engagement bracket 135. Each of the mounting brackets 132 contains lower mount flanges 134. The lower mount flanges 134 are adapted to receive the front end 112 (FIG. 3) of the pivot arm plate 110 (FIG. 3) wherein the pivot arm plate 110 attached to the lower mount flanges 134 with a pivot pin 118 (FIG. 3). The cylinder engagement bracket 135 contains apertures 136. The apertures 136 receive a pivot pin 137. The space within the cylinder engagement bracket 135 and the pivot pin 137 are adapted to receive the bucket cylinder 116 (FIG. 3). As the bucket cylinder 116 expands and contracts, the bucket assembly 130 rotates about the lower mount flanges 134.

Figure 5:
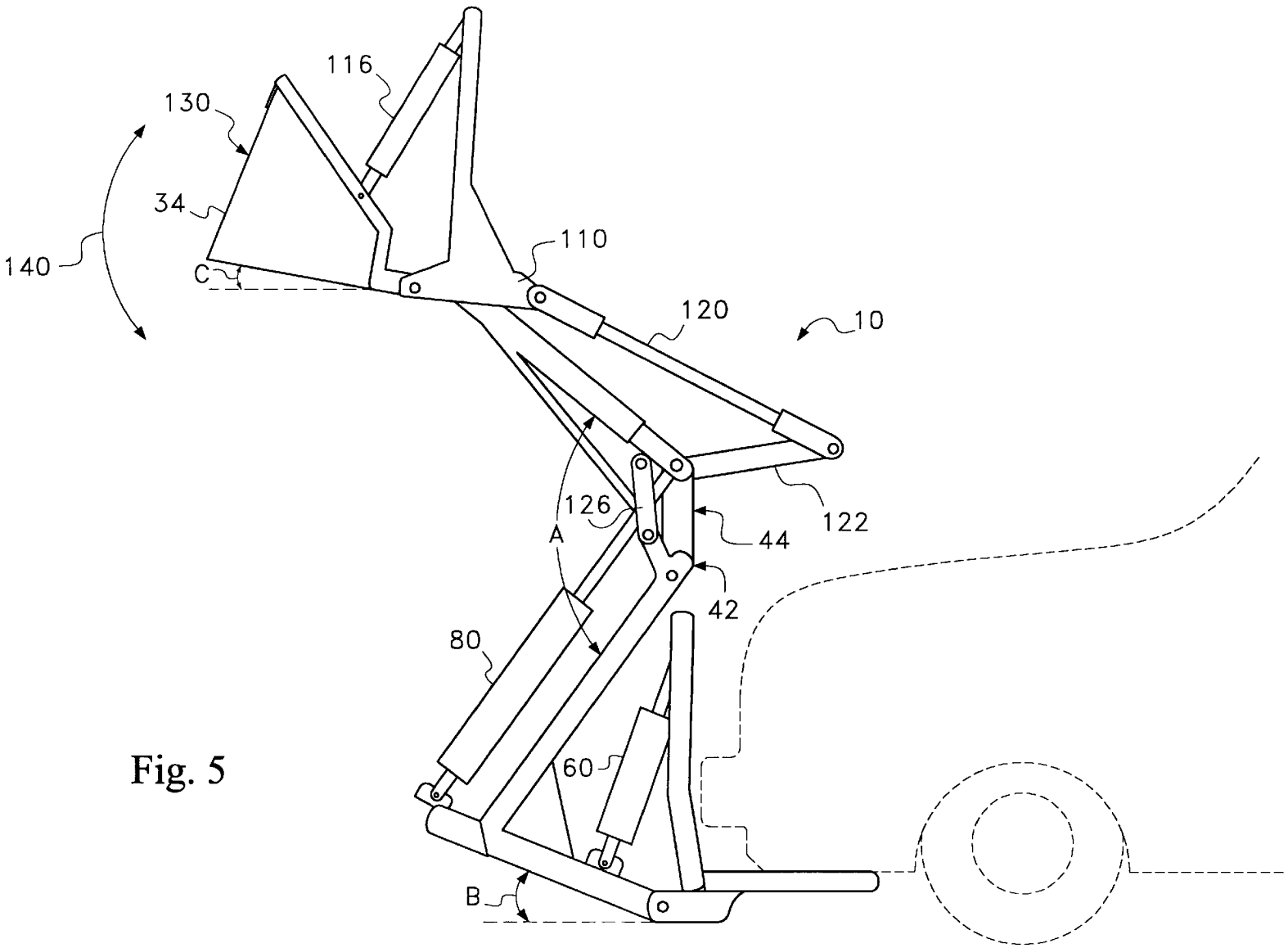
FIG. 5 is a side view of the present invention front end loader assembly shown in a vaulted position.

Referring to FIG. 5, it can be seen that as the bucket cylinder 116 expands and contracts, the bucket assembly 130 rotates about its mounts in the directions of arrow 140. As the lift arm cylinder 80 expands and contracts, the angle A between the lift arm frame assembly 44 and the L-shaped frame assembly 42 varies. Lastly, as the primary lift cylinder 60 expands and contacts, the angle B between the horizontal and the L-shaped frame assembly 42 can be varied.

The pivot arm plate 110, the first linkage arm 120, the second linkage arm 122 and the suspension linkages 126 serve the purpose keeping the orientation of the bucket 34 fairly constant as the lift arm cylinder 80 is expanded and contracted. In FIG. 5, the bucket is shown at an angle C of approximately 20 degrees with respect to the horizontal. The angle C can be maintained at a fixed value by the various linkages without need for readjusting the bucket cylinder 116. As the lift arm cylinder 80 is adjusted, the first linkage arm 120 and the second linkage arm 122 automatically readjust in position. As the first linkage arm 120 and the second linkage arm 122 adjust in position, the pivot arm plates 110 are caused to change in orientation. The change in orientation of the pivot arm plates 110 compensates for the movement of the lift arm frame assembly 44, thereby maintaining the bucket 34 at a relatively constant orientation angle C.

Figure 6:
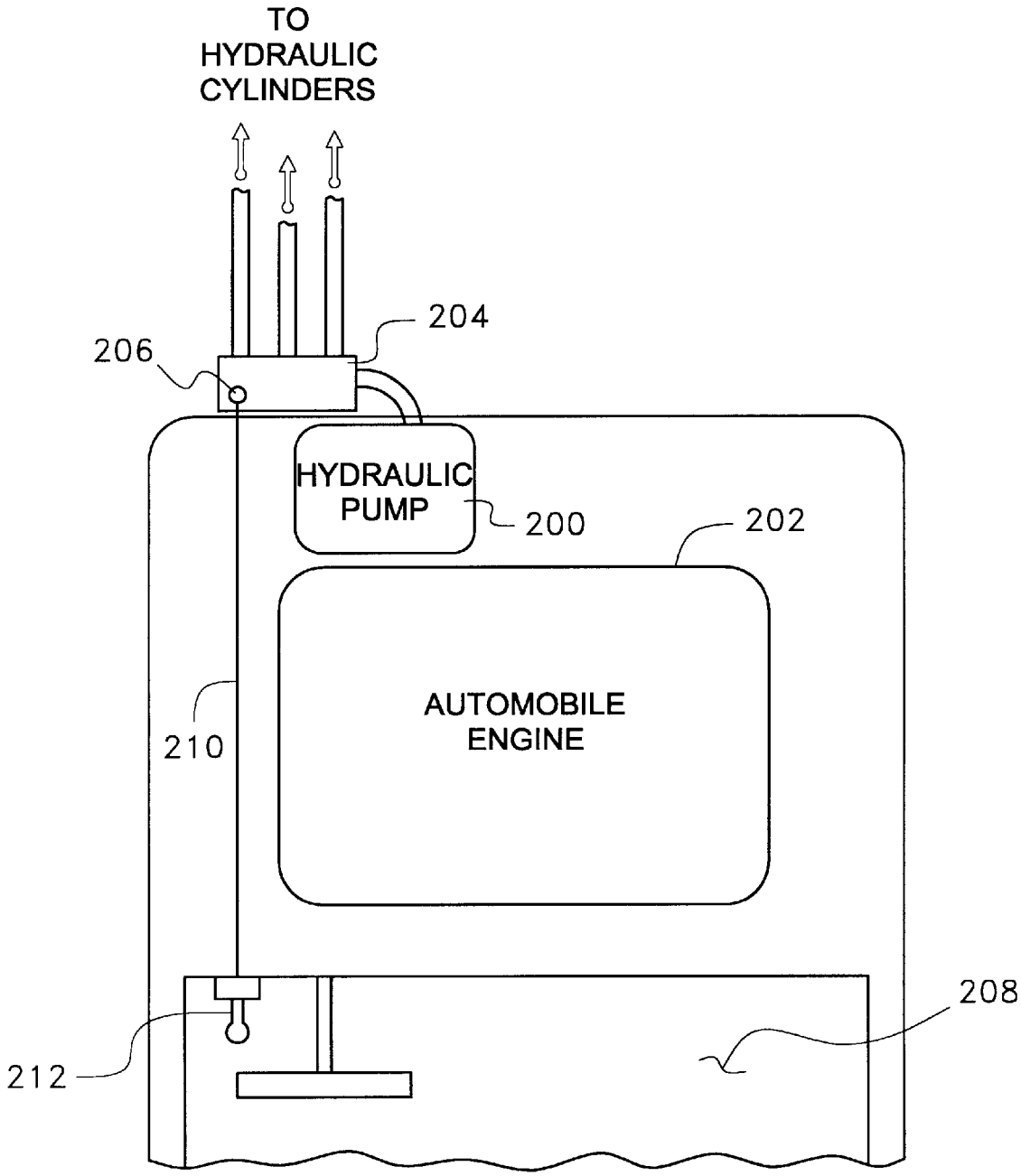
FIG. 6 is a schematic diagram illustrating the hydraulic controls for the present invention front end loader assembly.

Referring to FIG. 6, a schematic of the hydraulic controls for the exemplary embodiment are shown. To attach the present invention front end loader assembly to a vehicle, a hydraulic pump 200 is first added to the vehicle. The hydraulic pump can be electric. However, in the preferred embodiment, the hydraulic pump 200 is mechanical pump that runs from the rotation of the vehicle engine 202 via a fan belt or similar connection.

The hydraulic pump 200 is connected to a control manifold 204, wherein the control manifold 204 is affixed to all of the hydraulic cylinders contained within the front end loader assembly. The direction of the flow of hydraulic fluid from the hydraulic pump 200 to the hydraulic cylinders is controlled by the valving of the control manifold 204. The control manifold 204 can be attached to any stationary part of the vehicle or to the front end loader itself. The valving contained within the control manifold 204 is controlled by at least one control handle 206. To facilitate the operation of the control manifold 204 from within the passenger compartment 208 of the vehicle, at least one control cable 210 is strung from the passenger compartment 208 to the control manifold 204. The cable 210 is affixed to control levers 212 within the passenger compartment 208, wherein the manipulation of the control levers 212 is transferred to the control manifold 204 via the cable 210.

Returning to FIG. 5, it can be sen that the present invention front end loader assembly 10 can be attached to most any existing vehicle. Once attached, the front end loader assembly 10 can be used to scoop material from the ground, as is shown in FIG. 1 or lift material off of the ground, as is shown in FIG. 5. The use of the linkage elements 110, 120, 122, 126 on the bucket 34,eliminate the need for complicated controls when lifting the bucket 34. Consequently, the entire front end loader can be operated by controlling the expansion of the main lift cylinder 60, the arm lift cylinder 80 and the bucket cylinders 116. The use of only a few cylinders helps to make the front end loader assembly 10 be low cost, light weight and easy to operate.

It will be understood that a person skilled in the art of front end loader design can make alternate embodiments of the present invention using functionally equivalent components that have not been specifically described. For example, the size, shape, and location of the various frame elements and linkages can be changed as desired. All such obvious modifications are intended to be included in the scope of this disclosure as defined by the appended claims.

What is claimed is:

1. A front end loader assembly selectively attachable to a road vehicle of the type having a chassis frame and a front bumper, said assembly comprising:

a stationary mount having a base that is attachable to the vehicle chassis and a support frame that extends upwardly from said base in front of the vehicle's bumper;

a frame structure having a pair of generally vertical frame elements and at least one generally horizontal frame element, wherein said at least one generally horizontal frame element is pivotably coupled to said stationary mount at a first point of attachment;

a single first hydraulic cylinder extending between said stationary mount and said frame structure, wherein said first hydraulic cylinder is capable of moving said frame assembly relative said stationary mount about said first point of attachment;

an arm structure coupled to said frame structure by a hinged connection, said hinged connection existing between said vertical frame elements of said frame structure;

a single second hydraulic cylinder extending between said frame structure and said arm structure, wherein said second hydraulic cylinder is capable of moving said arm structure relative said frame assembly about said hinged connection;

a bucket coupled to said arm structure; and a third cylinder coupled between said bucket and said arm structure for selectively moving said bucket relative to said arm structure.

2. The assembly according to claim 1, further including pivot arm plates disposed between said bucket and said arm structure, wherein said pivot arm plates are coupled to said arm structure at a first pivot connection and are pivotably coupled to said bucket at a second pivot connection.

3. The assembly according to claim 2, further including a linkage assembly that is coupled to said pivot plates and rotates said pivot plates about said first pivot connection when said arm structure moves with respect to said frame structure, wherein said linkage assembly maintains said bucket at a predetermined orientation as said arm structure moves relative said frame structure.

4. The assembly according to claim 3, wherein said frame structure is generally L-shaped having a first end at one end of said at least one generally horizontal frame element and a second free end at the ends of said vertical frame elements.

5. The assembly according to claim 4, wherein said first free end of said frame structure is pivotably connected to said stationary mount.

6. The assembly according to claim 4, further including short arms that extend from said vertical frame elements proximate said second free end.

7. The assembly according to claim 6, wherein said linkage assembly connects to said short arms on said frame structure.

8. The assembly according to claim 4, wherein said vertical frame elements of said frame structure are spaced a predetermined distance apart and said arm structure has a width that is less than said predetermined distance.

9. The assembly according to claim 8, wherein said hinged connection between said arm structure and said frame structure includes a pivot rod that passes through said vertical frame elements of said frame structure and a portion of said arm structure positioned between said vertical frame elements.

* * * * *